United States Patent [19]

Bland et al.

[11] Patent Number: 4,654,013

[45] Date of Patent: Mar. 31, 1987

[54] STEERING MEANS FOR MARINE PROPULSION DEVICE

[75] Inventors: Gerald F. Bland, Glenview; Donald K. Sullivan, Waukegan, both of Ill.

[73] Assignee: Outboard Marine Corporation, Waukegan, Ill.

[21] Appl. No.: 698,874

[22] Filed: Feb. 6, 1985

[51] Int. Cl.[4] ..... B63H 25/42

[52] U.S. Cl. ..... 440/57; 440/63

[58] Field of Search ..... 440/49, 53, 57, 63, 440/113; 114/144 R; 74/480 B

[56] References Cited

U.S. PATENT DOCUMENTS

| | | | |
|---|---|---|---|
| 3,136,282 | 6/1964 | Alexander . | |
| 3,136,285 | 6/1964 | Kiekhaefer | 440/57 |
| 3,136,287 | 6/1964 | North | 440/57 |
| 3,181,494 | 5/1965 | Kiekhaefer et al. | 440/57 |
| 3,250,501 | 5/1966 | Alexander | 440/57 |
| 3,339,517 | 9/1967 | Bergstedt | 440/57 |
| 3,403,655 | 10/1968 | Warburton | 440/57 |
| 4,289,488 | 9/1981 | Weronke et al. | 440/57 |

*Primary Examiner*—Galen Barefoot
*Assistant Examiner*—Stephen P. Avila
*Attorney, Agent, or Firm*—Michael, Best & Friedrich

[57] ABSTRACT

A marine propulsion device comprising a gimbal housing adapted to be fixedly attached to the rear of a boat transom, a gimbal ring, and structure accessible from rearward of the boat transom for removably connecting the gimbal ring to the gimbal housing so as to provide for pivotal movement of the gimbal ring relative to the gimbal housing about a generally vertical steering axis.

48 Claims, 12 Drawing Figures

24
26
46
80
48
44
44
54
88
18
62
68
28

28
56
56
44
24
54
94
67
62
72
70
74
66
76
88
92
65
86
56
60
64
14
62
80
18

STEERING MEANS FOR MARINE PROPULSION DEVICE

BACKGROUND OF THE INVENTION

The invention relates to steering means for marine propulsion devices and, more particularly, to gimbal ring arrangements for stern drive or inboard/outboard marine propulsion devices.

Prior gimbal ring arrangements have had means accessible only from inside the boat, through the engine compartment, for removably connecting the gimbal ring to the gimbal housing. This complicates removal of the gimbal ring from the gimbal housing.

Attention is directed to the following U.S. patents which disclose gimbal ring type steering means for marine propulsion devices:

Kiekhaefer U.S. Pat. No. 3,136,285, issued June 9, 1964;

North U.S. Pat. No. 3,136,287, issued June 9, 1964;

Kiekhaefer U.S. Pat. No. 3,181,494, issued May 4, 1965;

Alexander U.S. Pat. No. 3,250,501, issued May 10, 1966;

Warburton U.S. Pat. No. 3,403,655, issued Oct. 1, 1968; and

Weronke U.S. Pat. No. 4,289,488, issued Sept. 15, 1981.

SUMMARY OF THE INVENTION

The invention provides a marine propulsion device comprising a gimbal housing adapted to be fixedly attached to the rear of a boat transom, a gimbal ring, and means accessible from rearward of the boat transom for removably connecting the gimbal ring to the gimbal housing so as to provide for pivotal movement of the gimbal ring relative to the gimbal housing about a generally vertical steering axis.

The invention also provides a marine propulsion device comprising a gimbal housing adapted to be fixedly attached to a boat transom, a gimbal ring, and means for removably connecting the gimbal ring to the gimbal housing for pivotal movement of the gimbal ring relative to the gimbal housing about a generally vertical steering axis, and for disconnecting the gimbal ring from the gimbal housing by moving the gimbal ring generally vertically relative to the gimbal housing.

In one embodiment, the marine propulsion device further comprises a propulsion unit, and means for removably connecting the propulsion unit to the gimbal ring for pivotal movement relative to the gimbal ring about a generally horizontal tilt axis, and for common pivotal movement with the gimbal ring about the steering axis.

In one embodiment, the means for removably connecting the propulsion unit to the gimbal ring includes a pivot housing, means for removably connecting the pivot housing to the gimbal ring for pivotal movement relative to the gimbal ring about a generally horizontal tilt axis, and for common pivotal movement with the gimbal ring about the steering axis, and means for removably connecting the propulsion unit to the pivot housing for common pivotal movement with the pivot housing.

In one embodiment, the gimbal ring includes a main opening permitting passage of the pivot housing therethrough in response to rearward movement of the gimbal ring after disconnection of the gimbal ring from the gimbal housing and disconnection of the pivot housing from the gimbal ring.

In one embodiment, the gimbal housing includes an upper portion, the gimbal ring includes an upper portion, the means removably connecting the gimbal ring to the gimbal housing includes a housing aperture in the upper portion of the gimbal housing and centered on the steering axis, and a gimbal pin extending upwardly from said upper portion of said gimbal ring and being received in the housing aperture, and the gimbal ring is removable from the gimbal housing by lowering the gimbal ring until the gimbal pin is removed from the housing aperture.

In one embodiment, the gimbal housing includes a lower portion, the gimbal ring includes a lower portion, the means removably connecting the gimbal ring to the gimbal housing includes a housing pin extending downwardly from the lower portion of the gimbal housing along the steering axis, and a gimbal aperture in the lower portion of the gimbal ring and receiving the housing pin, and the gimbal ring is removable from the gimbal housing by lowering the gimbal ring until the gimbal aperture is removed from the housing pin.

In one embodiment, the housing pin has an upper end fixed in the lower portion of the gimbal housing, a middle portion received in the gimbal aperture in the gimbal ring, and a lower end extending downwardly of the gimbal ring, and the marine propulsion device further comprises means for supporting the lower end of the housing pin.

In one embodiment, the means for supporting the lower end of the housing pin includes a support housing removably connected to the lower portion of the gimbal housing and including a support portion extending beneath the lower portion of the gimbal ring and having therein a support aperture receiving the lower end of the housing pin.

In one embodiment, the gimbal pin has an upper part, and the marine propulsion device further comprises a steering arm, and means for fixedly and removably attaching the steering arm to the upper part of the gimbal pin such that movement of the steering arm causes rotation of the gimbal ring about the steering axis.

In one embodiment, the means for fixedly and removably attaching the steering arm to the upper part of the gimbal pin includes a plurality of bolts extending through the steering arm and being threadedly engaged with the gimbal pin, and a plurality of pins extending through the steering arm and the gimbal pin, the bolts and the pins being generally parallel to the steering axis.

In one embodiment, the marine propulsion device further comprises means for supporting the gimbal ring against downward vertical displacement when the gimbal pin is received in the housing aperture and the housing pin is received in the gimbal aperture.

In one embodiment, the steering arm includes a lower surface, the gimbal housing includes an upper surface having therein the housing aperture, and the means for supporting the gimbal ring includes a thrust bearing positioned between a portion of the lower surface of the steering arm and the upper surface of the gimbal housing.

In one embodiment, the marine propulsion device further comprises means for supporting loads exerted upwardly on the gimbal ring.

In one embodiment, the gimbal housing includes a lower surface having the housing pin extending downwardly therefrom, the lower portion of the gimbal ring has an upper surface having therein the gimbal aperture, and the means for supporting loads exerted upwardly on the gimbal ring includes a thrust bearing between the lower surface of the gimbal housing and the upper surface of the lower portion of the gimbal ring.

In one embodiment, the gimbal ring includes spaced apart generally vertical side portions on opposite sides of the main opening, the pivot housing has a portion positioned inside the main opening of the gimbal ring adjacent the side portions of the gimbal ring, and the means for removably connecting the pivot housing to the gimbal ring includes, in each of the side portions of the gimbal ring, an aperture centered on the tilt axis and a bolt extending through the aperture and threadedly engaged with the portion of the pivot housing.

In one embodiment, the propulsion unit includes a rotatably mounted propeller, and a generally horizontal drive shaft drivingly connected to the propeller and extending through the pivot housing and the gimbal ring and being adapted to extend through the boat transom to be operably connected to an engine within the boat.

In one embodiment, the gimbal housing further includes a removable cover for affording access to the steering arm.

The invention also proivdes a marine propulsion device comprising a gimbal housing adapted to be fixedly attached to a boat transom, a gimbal ring having an upper portion, means for connecting the gimbal ring to the gimbal housing for pivotal movement of the gimbal ring relative to the gimbal housing about a generally vertical steering axis, the means including a gimbal pin extending generally upwardly from the upper portion of the gimbal ring and having an upper surface, and a housing aperture in the gimbal housing receiving the gimbal pin, a propulsion unit connected to the gimbal ring for pivotal movement relative to the gimbal ring about a generally horizontal tilt axis, and for common pivotal movement with the gimbal ring about the steering axis a steering arm, and means for fixedly attaching the steering arm to the upper surface of the gimbal pin such that movement of the steering arm causes rotation of the gimbal ring and of the propulsion unit about the steering axis, the means including a plurality of bolts extending through the steering arm and being threadedly engaged with the gimbal pin, and a plurality of pins extending through the steering arm and the gimbal pin, the bolts and the pins being generally parallel to the steering axis.

The invention also provides a marine propulsion device comprising a gimbal housing including an upper surface and being adapted to be fixedly attached to a boat transom, a gimbal ring having an upper portion, means for connecting the gimbal ring to the gimbal housing for pivotal movement of the gimbal ring relative to the gimbal housing about a generally vertical steering axis, the means including a gimbal pin extending generally upwardly from the upper portion of the gimbal ring, and a housing aperture in the gimbal housing receiving the gimbal pin, a steering arm including a lower surface and being fixedly attached to the gimbal pin such that movement of the steering arm causes rotation of the gimbal ring and of the propulsion unit about the steering axis, and means for supporting the gimbal ring against downward vertical displacement when the gimbal pin is received in the housing aperture, the means for supporting the gimbal ring including a thrust bearing positioned between a portion of the lower surface of the steering arm and the upper surface of the gimbal housing.

The invention also provides a marine propulsion device comprising a gimbal housing adapted to be fixedly attached to a boat transom and including a lower portion having a housing pin extending downwardly therefrom along a generally vertical steering axis, the housing pin having a lower end, an intermediate portion, and an upper end fixedly attached to the lower portion of the gimbal housing, a gimbal ring removably connected to the gimbal housing for pivotal movement relative to the gimbal housing about the steering axis, the gimbal ring including a lower portion having therein a gimbal aperture receiving the intermediate portion of the housing pin, and a support housing removably connected to the lower portion of the gimbal housing and including a support portion extending beneath the lower portion of the gimbal ring and having therein a support aperture receiving the lower end of the housing pin.

A principal feature of the invention is the provision of means accessible from rearward of the boat transom for removably connecting the gimbal ring to the gimbal housing. This allows removal and replacement or repair of the gimbal ring without requiring access to the gimbal ring through the engine compartment. This greatly simplifies replacement or repair of the gimbal ring.

Another principal feature of the invention is the provision of means for removably connecting the gimbal ring to the gimbal housing for pivotal movement of the gimbal ring relative to the gimbal housing about a generally vertical steering axis, and for disconnecting the gimbal ring from the gimbal housing by moving the gimbal ring generally vertically relative to the gimbal housing.

Another principal feature of the invention is the provision of a support housing removably connected to the lower portion of the gimbal housing and including a support portion extending beneath the lower portion of the gimbal ring and having therein a support aperture receiving the lower end of the housing pin. This simplifies removal of the gimbal ring.

Another principal feature of the invention is the provision of means for fixedly and removably attaching the steering arm to the upper part of the gimbal pin such that movement of the steering arm causes rotation of the gimbal ring about the steering axis. Preferably, the means for fixedly and removably attaching the steering arm to the upper part of the gimbal pin includes a plurality of bolts extending through the steering arm and being threadedly engaged with the gimbal pin, and a plurality of pins extending through the steering arm and the gimbal pin, the bolts and the pins being generally parallel to the steering axis.

Another principal feature of the invention is the provision of means for supporting the gimbal ring against downward vertical displacement when the gimbal pin is received in the housing aperture and the housing pin is received in the gimbal aperture.

Another principal feature of the invention is the provision of means for supporting loads exerted upwardly on the gimbal ring.

Another principal feature of the invention is the provision of a removable cover for affording access to the steering arm. This also simplifies removal of the gimbal ring.

Various other features and advantages of the invention are set forth in the following detailed description, claims, and drawings.

Figure 1:
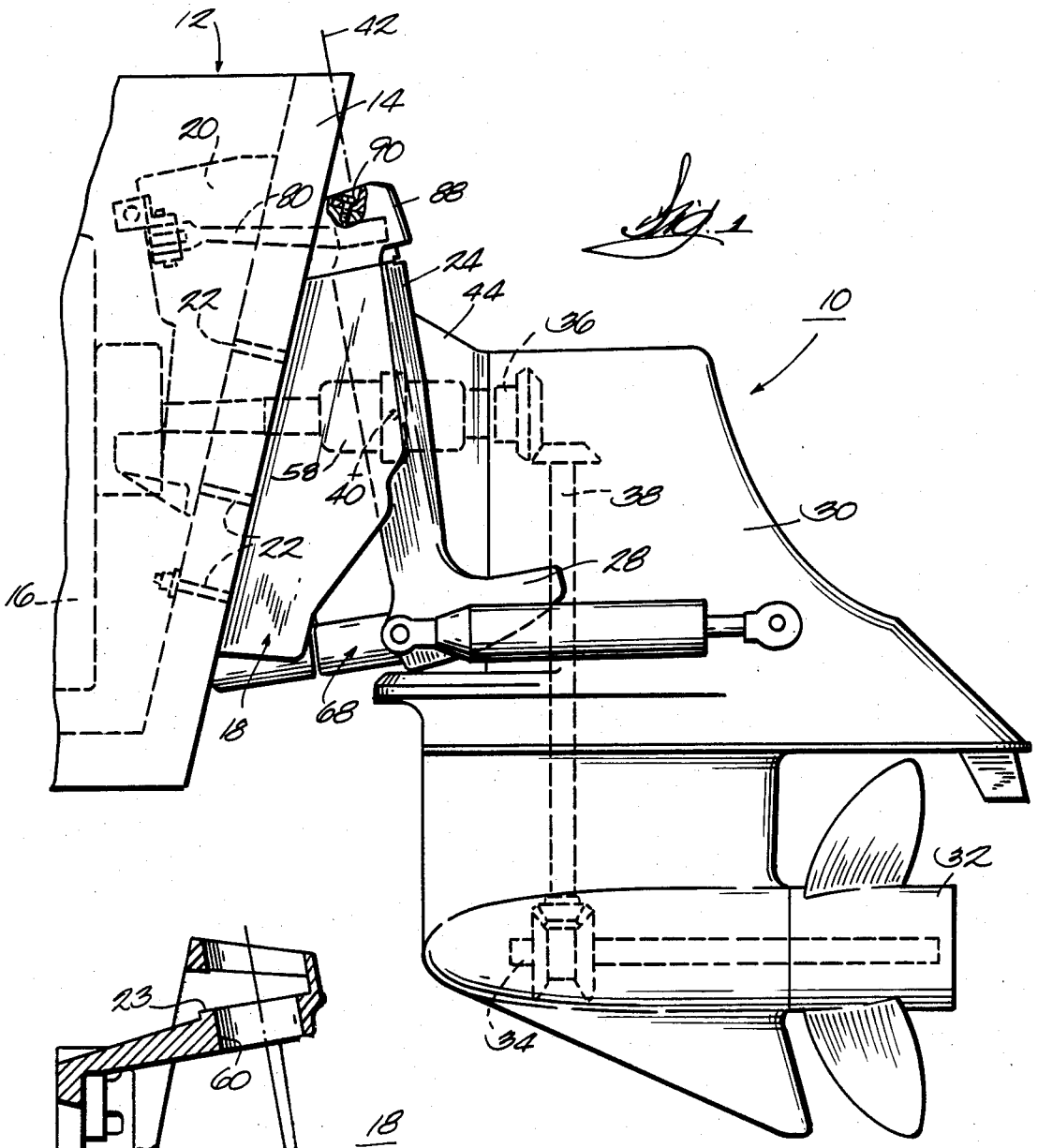
FIG. 1 is a side elevational view of a marine propulsion device embodying the invention and mounted on a boat.

Before exaplaining one embodiment of the invention in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a marine propulsion device 10 mounted on a boat 12 having a transom 14. The marine propulsion device 10 is of the stern drive or inboard/outboard type.

As best shown in FIG. 1, the marine propulsion device comprises an engine 16 securely mounted on the boat frame by suitable means such as rubber mounts (not shown). The marine propulsion device 10 also comprises a gimbal housing 18 mounted on the outer surface of the boat transom 14, and a transom plate 20 mounted on the inner surface of the boat transom 14. The gimbal housing 18 is fixedly attached to the boat transom 14 by a plurality of bolts 22 extending through the boat transom 14 to secure the gimbal housing 18 to the transom plate 20 and to the transom 14.

Figure 5:
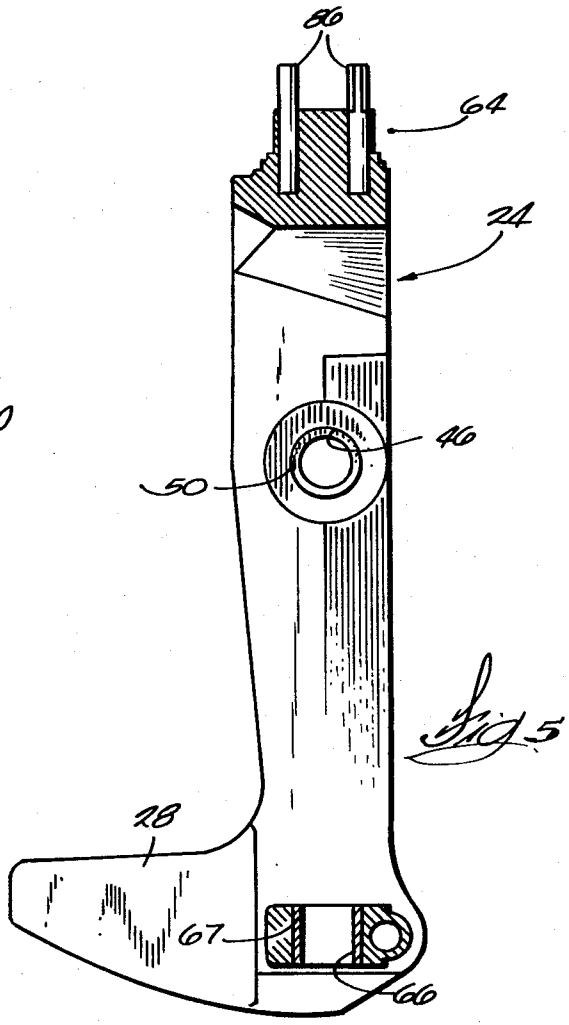
FIG. 5 is a cross-sectional view taken along line 5—5 in FIG. 4 (from the left in FIG. 4).
Figure 4:
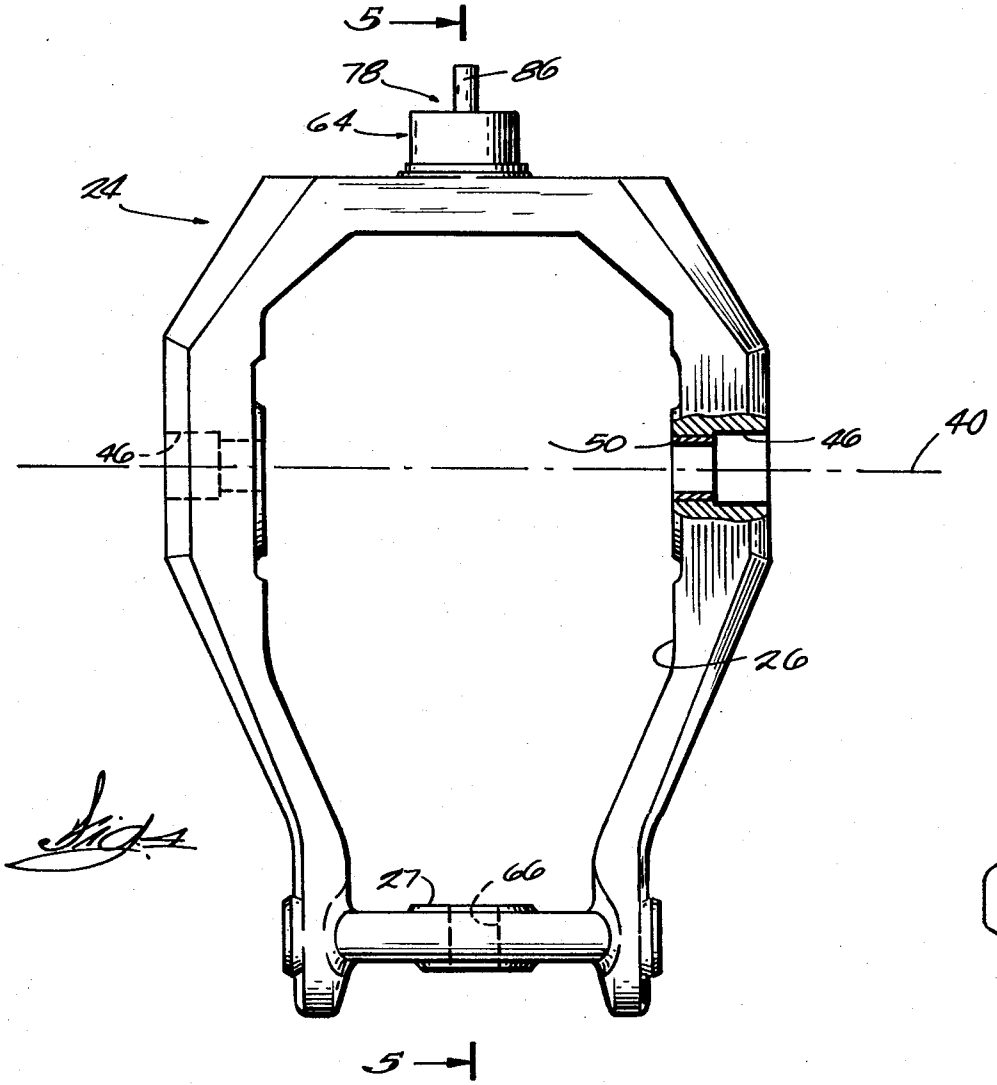
FIG. 4 is a front view (from the left in FIG. 2) of the gimbal ring.

The marine propulsion device 10 also comprises a gimbal ring 24. In the illustrated construction, as best illustrated in FIGS. 4 and 5, the gimbal ring 24 actually has a shape that is more rectangular than circular, the gimbal ring 24 having spaced apart generally horizontal upper and lower portions and spaced apart generally vertical side portions defining a main opening 26. The lower portion of the gimbal ring 24 has an upper surface 27. Extending rearwardly from the lower end of each of the vertical side portions of the gimbal ring 24 is a projection 28 that will be explained hereinafter.

As best shown in FIG. 1, the marine propulsion device 10 also comprises a propulsion unit 30 including a propeller 32 mounted on a propeller shaft 34, and a generally horizontally drive shaft 36 having one end removably connected to the engine 16 and an opposite end having thereon a bevel gear. The bevel gear drives a bevel gear on the upper end of a vertical drive shaft 38. The lower end of the vertical drive shaft 38 has thereon a driving gear, and a pair of driven gears are selectively clutched to the propeller shaft 34 to transmit forward or reverse motion to the propeller shaft 34 from the driving gear.

The marine propulsion device 10 further comprises means for removably connecting the propulsion unit 30 to the gimbal ring 24 for pivotal movement relative to the gimbal ring 24 about a generally horizontal tilt axis 40, and for common pivotal movement with the gimbal ring 24 about a generally vertical steering axis 42. While various suitable means can be employed for this purpose, in the preferred embodiment, such means includes a pivot housing 44, and means for removably connecting the pivot housing 44 to the gimbal ring 24 for pivotal movement relative to the gimbal ring 24 about the tilt axis 40, and for common pivotal movement with the gimbal ring 24 about the steering axis 42.

Figure 3:
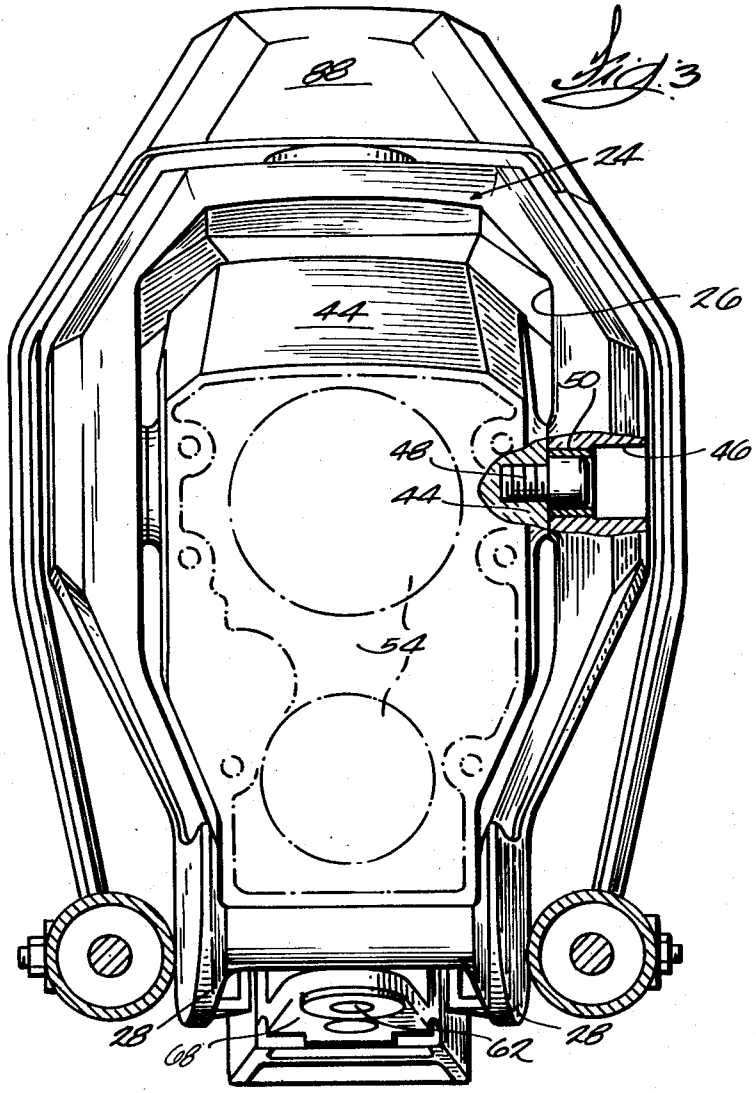
FIG. 3 is a rear view (from the right in FIG. 2) of the marine propulsion device with the propulsion unit removed.
Figure 2:
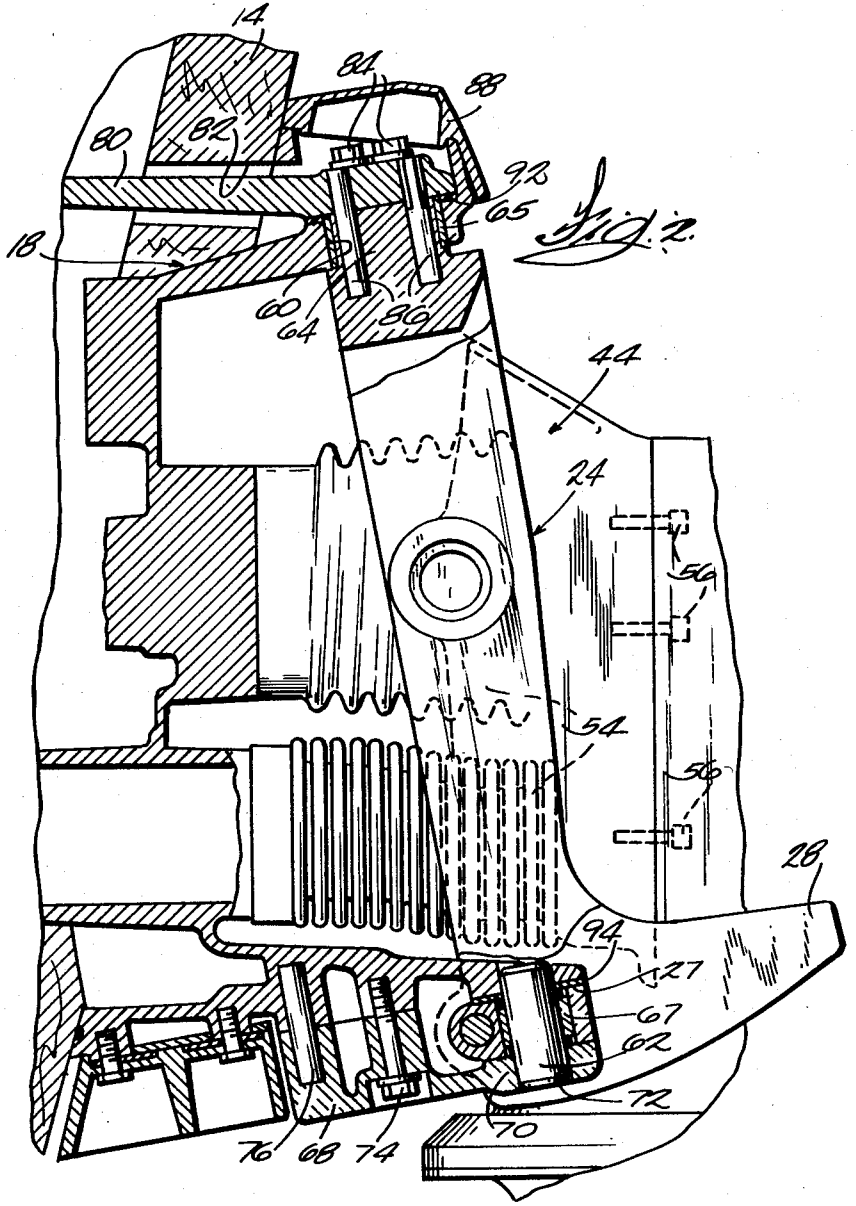
FIG. 2 is a partial cross-sectional view of the marine propulsion device.

In the preferred embodiment, as best shown in FIGS. 2 and 3, the pivot housing 44 has a front end or portion positioned inside the main opening 26 of the gimbal ring 24 adjacent the side portions of the gimbal ring 24, and the means for removably connecting the pivot housing 44 to the gimbal ring 24 includes, in each of the side portions of the gimbal ring 24, an aperture 46 centered on the tilt axis 40, and a bolt 48 extending through the aperture 46 and threadedly engaged with the front portion of the pivot housing 44. As best shown in FIG. 3, the heads of the bolts 48 are circular and are received inside journal bearings 50 which are received within the apertures 46 in the gimbal ring 24. Thus, the heads of the bolts 48 rotate relative to the gimbal ring 24, and the threaded portions of the bolts 48 are fixed to the pivot housing 44 so that the pivot housing 44 rotates with the bolts 48 relative to the gimbal ring 24.

The remainder of the pivot housing 44, other than the front portion, extends rearwardly of the gimbal ring 24 when the pivot housing 44 is connected to the gimbal ring 24. The shape of the pivot housing 44 and the size of the main opening 26 in the gimbal ring 24 are such that the pivot housing 44 can pass through the main opening 26 in the gimbal ring 24. The reason for this is explained hereinafter.

Figure 6:
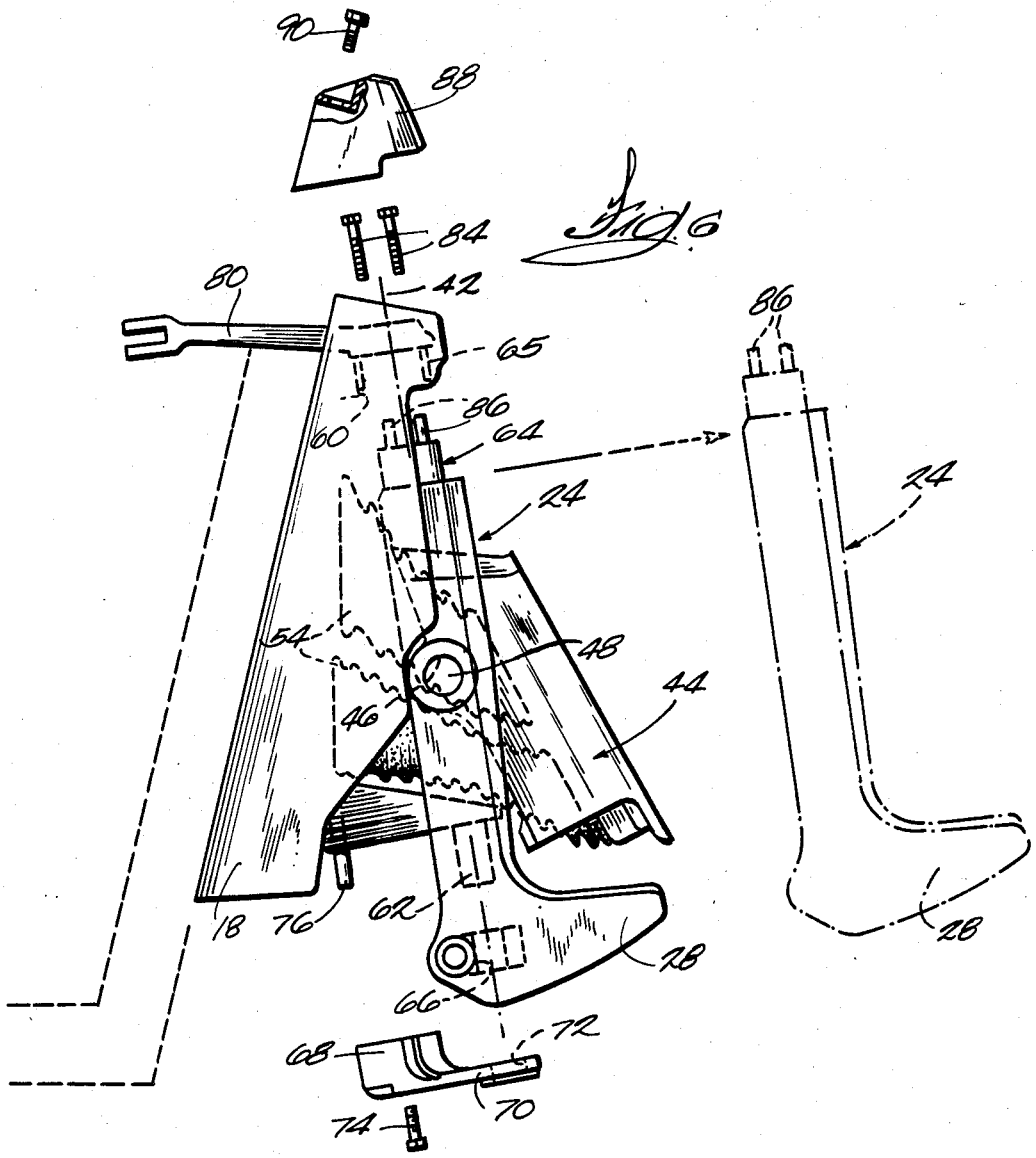
FIG. 6 is an exploded partial view of the marine propulsion device showing how the gimbal ring is removed.

In addition to being connected to the gimbal ring 24, in the preferred embodiment, the pivot housing 44 is also flexibly connected to the gimbal housing 18 by bellows 54, as best shown in FIG. 2. When the pivot housing 44 is disconnected from the gimbal ring 24, the pivot housing 44 remains connected to the gimbal housing 18 by the bellows 54, as best shown in FIG. 6. Furthermore, in the preferred embodiment, other components (not shown) adapted to be connected to the propulsion unit 30, such as a shift cable and water hose, extend through the pivot housing 44.

The means for removably connecting the propulsion unit 30 to the gimbal ring 24 also includes means for removably connecting the propulsion unit 30 to the pivot housing 44 for common pivotal movement of the propulsion unit 30 with the pivot housing 44. While various suitable means can be employed for this purpose, in the illustrated construction (see FIG. 2), such means includes a plurality of bolts 56 fixedly and removably attaching the propulsion unit 30 to the pivot housing 44. When the propulsion unit 30 is connected to the pivot housing 44, the horizontal drive shaft 36, which extends forwardly of the propulsion unit 30, is removably connected to the engine 16, as shown in FIG. 1. A universal joint 58 in the horizontal drive shaft 36 allows pivotal movement of the drive shaft 36 with the propulsion unit 30.

When the propulsion unit 30 and pivot housing 44 are connected to the gimbal ring 24, the projections 28 extending rearwardly from the gimbal ring 24 extend adjacent portions of the propulsion unit 30 and pivot housing 44, as best shown in FIG. 1. The projections 28 serve to additionally absorb sideways forces applied to the propulsion unit 30. (The bulk of sideways support for the propulsion unit 30 is provided by the pivotal connection of the pivot housing 44 to the gimbal ring 24.)

The marine propulsion device 10 also comprises means accessible from rearward of the boat transom 14 for removably connecting the gimbal ring 24 to the gimbal housing 18 so as to provide for pivotal movement of the gimbal ring 25 relative to the gimbal housing 18 about the steering axis 42. In the preferred embodiment, such means includes means for removably connecting the gimbal ring 24 to the gimbal housing 18 for pivotal movement of the gimbal ring 24 relative to the gimbal housing 18 about the steering axis 42, and for disconnecting the gimbal ring 24 from the gimbal housing 18 by moving the gimbal ring 24 generally vertically relative to the gimbal housing 18.

Figure 8:
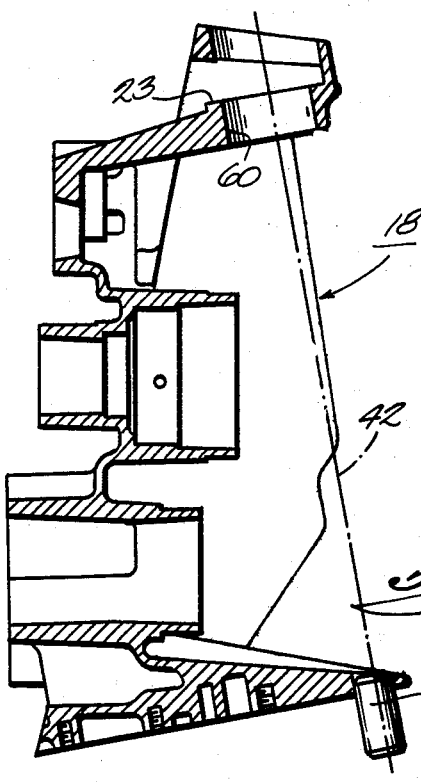
FIG. 8 is a cross-sectional view of the gimbal housing.

While various suitable means can be employed for this purpose, in the preferred embodiment, such means includes a housing aperture 60 in the upper portion of the gimbal housing 18 and centered on the steering axis 42, and a housing pin 62 extending downwardly from the lower portion of the gimbal housing 18 along the steering axis 42, as best shown in FIGS. 2 and 8. The means also includes a gimbal pin 64 extending upwardly from the upper portion of the gimbal ring 24 and received in the housing aperture 60, and a gimbal aperture 66 in the lower portion of the gimbal ring 24 and receiving the housing pin 62, as best shown in FIGS. 2, 4 and 5. In the preferred embodiment, a journal bearing 65 is between the gimbal pin 64 and the housing aperture 60, a journal bearing 67 is between the housing pin 62 and the gimbal aperture 66, and the upper end of the housing pin 62 is press fitted into an aperture in the lower portion of the gimbal housing 18. The gimbal ring 24 is rotatable relative to the gimbal housing 18 about the steering axis 42 since both the housing pin 62 and housing aperture 60 are centered on the steering axis 42. In the preferred embodiment, the gimbal ring 24 is disconnected from the gimbal housing 18 by lowering the gimbal ring 24 relative to the gimbal housing 18, as indicated in FIG. 6.

The marine propulsion device 10 further comprises means for supporting the lower end of the housing pin 62. While various suitable means can be employed for this purpose, in the illustrated construction (see FIGS. 2 and 6), such means includes a support housing 68 removably connected to the lower portion of the gimbal housing 18 and including a support portion 70 extending beneath the lower portion of the gimbal ring 24 and having therein a support aperture 72 receiving the lower end of the housing pin 62. In the preferred embodiment, the support housing 68 is removably connected to the lower portion of the gimbal housing 18 by a bolt 74 and pins 76 (only one is shown), as best shown in FIG. 2. Obviously, disconnection of the gimbal ring 24 from the gimbal housing 18 requires that the support housing 68 first be removed from the gimbal housing 18 so that the gimbal ring 24 can be lowered relative to the gimbal housing 18.

In the preferred embodiment, the gimbal pin 64 has an upper surface 78 (see FIG. 4), the upper portion of the gimbal housing 18 has an upper surface 23 (see FIG. 8), and the marine propulsion device 10 further comprises a steering arm 80 (see FIGS. 1 and 2), and means for fixedly and removably attaching the steering arm 80 to the upper surface 78 of the gimbal pin 64 such that movement of the steering arm 80 causes steering rotation of the gimbal ring 24 about the steering axis 42. As best shown in FIG. 2, the steering arm 80 has a lower surface fixedly and removably attached to the gimbal pin 64, and an end extending through an opening 82 in the transom 14 and being adapted to be connected to remote means, such as push-pull cables (not shown), for controlling steering movement of the steering arm 80. The steering arm 80 is attached to the gimbal pin 64 with a portion of the lower surface of the steering arm 80 abutting the upper surface 78 of the gimbal pin 64, and with a portion of the lower surface of the steering arm 80 extending above the upper surface 23 of the gimbal housing 18, as best shown in FIG. 2. In FIG. 2, a thrust bearing 92, the purpose of which will be explained hereinafter, is positioned between the lower surface of the steering arm 80 and the upper surface 23 of the gimbal housing 18.

Figure 7:
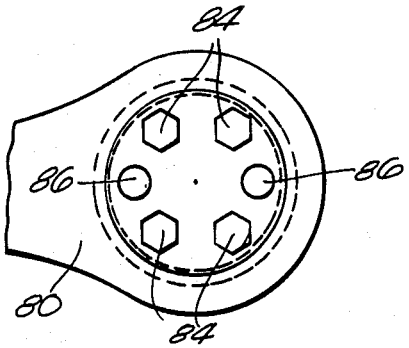
FIG. 7 is a top view of the portion of the steering arm that is connected to the gimbal ring.

While various suitable means can be used for fixedly and removably attaching the steering arm 80 to the upper surface 78 of the gimbal pin 64, in the preferred embodiment, such means includes a plurality of bolts or studs 84 extending through the steering arm 80 and being threadedly engaged with the gimbal pin 64, and a plurality of pins 86 extending through the steering arm 80 and the gimbal pin 64, the bolts 84 and pins 86 being generally parallel to the steering axis 42. More particularly, in the preferred embodiment, two pins 86 and four bolts 84 are used. The bolts 84 and pins 86 are best shown in FIGS. 2 and 7. The pins 86 support steering loads and provide a positive and accurate positioning of the steering arm 80 relative to the gimbal ring 24. The bolts 84 support steering loads and provide a positive fastening of the steering arm 80 to the gimbal ring 24, substantially eliminating any axial movement of the steering arm 80 relative to the gimbal ring 24. Furthermore, the bolts 84 cause frictional forces between the steering arm 80 and gimbal pin 64 that resist rotation of the steering arm 80 relative to the gimbal ring 24 and further support steering loads.

As best shown in FIGS. 2 and 6, in the preferred embodiment, the gimbal housing 18 includes a removable cover 88 for affording access to the steering arm 80. The cover 88 is removably secured to the gimbal housing 18 by a pair of bolts 90 (only one is shown in FIG. 6). Removal of the cover 88 permits removal of the bolts 84 securing the steering arm 80 to the gimbal ring 24, as shown in FIG. 6, and removal of the bolts 84 allows lowering of the gimbal ring 24 in order to disconnect it from the gimbal housing 18.

The marine propulsion device 10 also comprises means for supporting the gimbal ring 24 against downward vertical displacement when the gimbal pin 64 is received in the housing aperture 60 and the housing pin 62 is received in the gimbal aperture 66. While various suitable means can be employed for this purpose, in the illustrated construction (see FIG. 2), such means includes the thrust bearing 92 between the lower surface of the steering arm 80 and the upper surface 23 of the gimbal housing 18.

The marine propulsion device 10 further comprises means for supporting loads exerted upwardly on the gimbal ring 24. While various suitable means can be employed for this purpsoe, in the preferred embodiment (see FIG. 2), such means includes a thrust bearing 94 between the gimbal housing lower surface, which has the housing pin 62 extending downwardly therefrom, and the upper surface 27 of the lower portion of the gimbal ring 24.

When the marine propulsion device 10 is completely assembled, removal of the gimbal ring 24 from the gimbal housing 18 is performed as follows and as indicated in FIG. 6. First, the propulsion unit 30 is disconnected from the pivot housing 44. This separates the horizontal drive shaft 36 from the engine 16 at a point near the engine 16 so that the drive shaft 36 no longer extends through the gimbal housing 18, gimbal ring 24, and pivot housing 44. In FIG. 6, the propulsion unit 30 is already disconnected from the pivot housing 44 and is not shown.

Next, the support housing 68 is disconnected from the gimbal housing 18 so that the support aperture 72 is removed from the housing pin 62. The support housing 68 is disconnected by removing the bolts 74 and lowering the support housing 68. This allows subsequent lowering of the lower portion of the gimbal ring 24 so that the gimbal aperture 66 is removed from the housing pin 62. Next, the cover 88 is removed from the gimbal housing 18 to allow access to the steering arm 80. The cover 88 is removed by removing the bolts 90 and raising the cover 88. Next, the bolts 84 are removed from the steering arm 80 so that the steering arm 80 is disconnected from the gimbal pin 64. This allows subsequent lowering of the upper portion of the gimbal ring 24 so that the gimbal pin 64 is removed from the housing aperture 60.

Next, the gimbal ring 24 is lowered until the gimbal aperture 66 is removed from the housing pin 62 and the gimbal pin 64 is removed from the housing aperture 60. The gimbal ring 24 is shown in this position in FIG. 6. The gimbal ring 24 must also be lowered far enough so that the pins 86 are removed from the housing aperture 60. Next, the pivot housing 44 is disconnected from the gimbal ring 24. This is done by removing the bolts 48.

In some embodiments of the invention, depending on the positioning of the bellows 54 and other components (not shown) extending through the pivot housing 44 and the gimbal ring 24, the pivot housing 44 may be disconnected from the gimbal ring 24 before lowering the gimbal ring 24. In some instances, the pivot housing 44 can be tilted relative to the gimbal ring 24 (as shown in FIG. 6) in order to allow the pivot housing 44 and the bellows 54 to clear the lower portion of the gimbal housing 18 when the gimbal ring 24 is lowered relative to the gimbal housing 18. Finally, the gimbal ring 24 is passed rearwardly over the pivot housing 44 (as shown by the arrow in FIG. 6) which remains connected to the gimbal housing 18 by the bellows 54. When the gimbal ring 24 clears the pivot housing 44, removal is complete.

It should be understood that removal of the gimbal ring 24 can also be accomplished by disconnecting the pivot housing 44 from the gimbal housing 18 instead of disconnecting the propulsion unit 30 from the pivot housing 44. However, in the preferred embodiment, this is more difficult than removing the propulsion unit 30 from the pivot housing 44.

Figure 9:
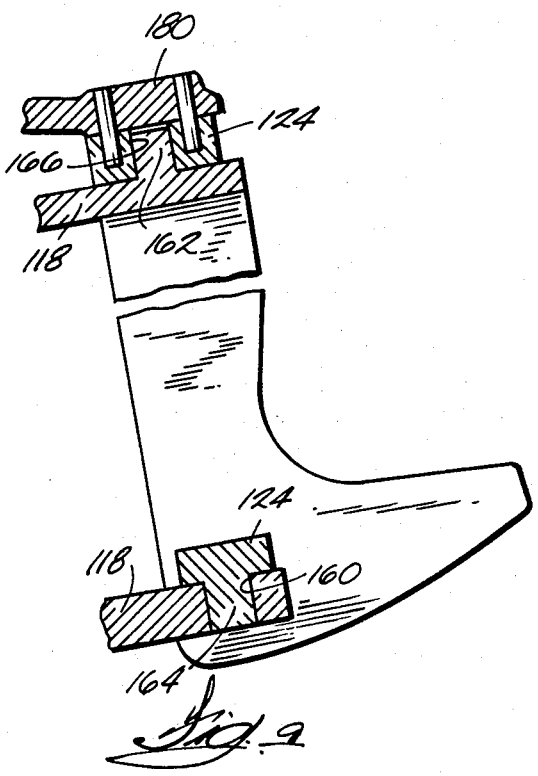
FIGS. 9–12 illustrate alternative embodiments of the means for connecting the gimbal ring to the gimbal housing, and for disconnecting the gimbal ring from the gimbal housing by moving the gimbal ring generally vertically relative to the gimbal housing. .

It should also be understood that other means for removably connecting the gimbal ring to the gimbal housing are within the scope of the claims. In one alternative embodiment, as shown in FIG. 9, the gimbal pin 164 extends downwardly from the lower portion of the gimbal ring 124, and the gimbal aperture 166 is in the upper portion of the gimbal ring 124. In this alternative embodiment, the lower portion of the gimbal housing 118 extends beneath the lower portion of the gimbal ring 124 and includes a housing aperture 160 receiving the gimbal pin 164, and the upper portion of the gimbal housing 118 extends beneath the upper portion of the gimbal ring 124 and includes a housing pin 162 extending upwardly therefrom and being received in the gimbal aperture 166. The gimbal ring 124 is removed from the gimbal housing 118 by being moved upwardly until the housing pin 162 is removed from the gimbal aperture 166 and the gimbal pin 164 is removed from the housing aperture 160. The steering arm 180 is attached to the upper portion of the gimbal ring 124.

Figure 11:
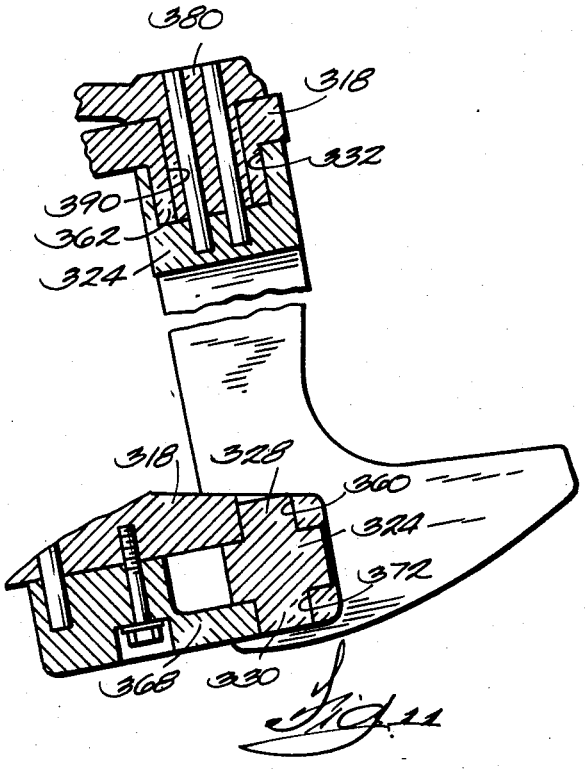
Figure 10:
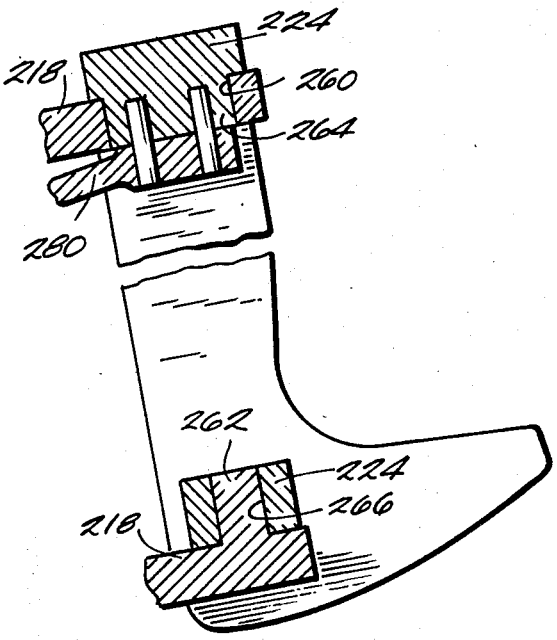
Figure 12:
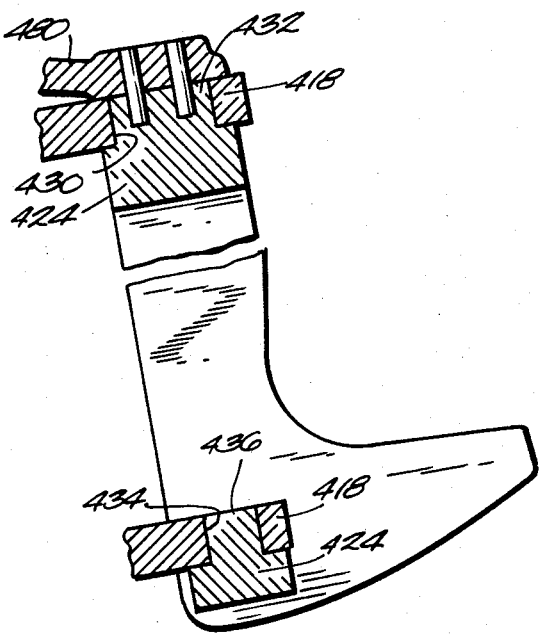

Illustrated in FIGS. 10–12 are further alternative embodiments of the means for removably connecting the gimbal ring to the gimbal housing, and for disconnecting the gimbal ring from the gimbal housing by moving the gimbal ring generally vertically relative to the gimbal housing.

In FIG. 10, the housing pin 262 extends upwardly from the lower portion of the gimbal housing 218, and the gimbal pin 264 extends downwardly from the upper portion of the gimbal ring 224. The lower portion of the gimbal ring 224 is positioned above the lower portion of the gimbal housing 218 and includes a gimbal aperture 266 receiving the housing pin 262, and the upper portion of the gimbal housing 218 extends beneath the upper portion of the gimbal ring 224 and includes a housing aperture 260 receiving the gimbal pin 264. The steering arm 280 is fixedly attached to the lower surface of the gimbal pin 224. In this alternative embodiment, the gimbal ring 224 is disconnected from the gimbal housing 218 by disconnecting the steering arm 280 from the gimbal pin 264 and moving the gimbal ring 224 upwardly relative to the gimbal housing 218.

In FIG. 11, the upper portion of the gimbal housing 318 extends above the upper portion of the gimbal ring 324, and the lower portion of the gimbal housing 318 extends above the lower portion of the gimbal ring 324. The lower portion of the gimbal ring 324 includes an upwardly extending pin 328 received in a housing aperture 360 in the lower portion of the gimbal housing 318, and a downwardly extending pin 330 received in a support aperture 372 in the support housing 368. The upper portion of the gimbal ring 324 includes an aperture 332 receiving a housing pin 362 extending downwardly from the upper portion of the gimbal housing 318. The housing pin 362 and upper portion of the gimbal housing 318 have extending therethrough an aperture 390 centered on the steering axis. The steering arm 380 is mounted above the upper portion of the gimbal housing 318 and has a portion extending downwardly through the aperture 390 through the housing pin 362 and fixedly attached to the upper portion of the gimbal ring 324. In this alternative embodiment, the gimbal ring 324 is disconnected from the gimbal housing 318 by disconnecting the steering arm 380 from the gimbal ring 324 and the support housing 368 from the gimbal housing 318, and then by lowering the gimbal ring 324 relative to the gimbal housing 318.

In FIG. 12, the upper portion of the gimbal housing 418 extends above the upper portion of the gimbal ring 424, and the lower portion of the gimbal housing extends above the lower portion of the gimbal ring 424. The upper portion of the gimbal housing 418 includes an aperture 430 receiving a pin 432 extending upwardly from the upper portion of the gimbal ring 424, and the lower portion of the gimbal housing 418 includes an aperture 434 receiving a pin 436 extending upwardly from the lower portion of the gimbal ring 424. The steering arm 480 is attached to the upper surface of the pin 432. The gimbal ring 424 is disconnected from the gimbal housing 418 by disconnecting the steering arm 480 from the gimbal ring 424, and then by lowering the gimbal ring 424 relative to the gimbal housing 418.

Various features of the invention are set forth in the following claims.

We claim:

1. A marine propulsion device comprising a gimbal housing adapted to be fixedly attached to the rear of a boat transom, a gimbal ring having a perimeter, a steering link, and means located outwardly of said perimeter and accessible from rearward of the boat transom for removably connecting said gimbal ring to said gimbal housing and to said steering link so as to provide for pivotal movement of said gimbal ring relative to said gimbal housing about a generally vertical steering axis.

2. A marine propulsion device in accordance with claim 1 wherein said means for removably connecting said gimbal ring to said gimbal housing include means for disconnecting said gimbal ring from said gimbal housing by initially moving said gimbal ring generally vertically relative to said gimbal housing.

3. A marine propulsion device comprising a gimbal housing adapted to be fixedly attached to a boat transom, a gimbal ring, and means for removably connecting said gimbal ring to said gimbal housing for pivotal movement of said gimbal ring relative to said gimbal housing about a generally vertical steering axis and for disconnecting said gimbal ring from said gimbal housing by initially moving said gimbal ring generally vertically relative to said gimbal housing.

4. A marine propulsion device in accordance with claim 3 wherein said marine propulsion device further comprises a propulsion unit, and means for removably connecting said propulsion unit to said gimbal ring for pivotal movement relative to said gimbal ring about a generally horizontal tilt axis, and for common pivotal movement with said gimbal ring about said steering axis.

5. A marine propulsion device in accordance with claim 4 wherein said means for removably connecting said propulsion unit to said gimbal ring includes a pivot housing, means for removably connecting said pivot housing to said gimbal ring for pivotal movement relative to said gimbal ring about said tilt axis, and for common pivotal movement with said gimbal ring about said steering axis, and means for removably connecting said propulsion unit to said pivot housing for common pivotal movement with said pivot housing.

6. A marine propulsion device in accordance with claim 5 wherein said gimbal ring includes a main opening permitting passage of said pivot housing therethrough in response to rearward movement of said gimbal ring after disconnection of said gimbal ring from said gimbal housing and disconnection of said pivot housing from said gimbal ring.

7. A marine propulsion device in accordance with claim 3 wherein said gimbal housing includes an upper portion, wherein said gimbal ring includes an upper portion, wherein said means removably connecting said gimbal ring to said gimbal housing includes a housing aperture in said upper portion of said gimbal housing and centered on said steering axis, and a gimbal pin extending upwardly from said upper portion of said gimbal ring and being received in said housing aperture, and wherein said gimbal ring is removable from said gimbal housing by initially lowering said gimbal ring until said gimbal pin is removed from said housing aperture.

8. A marine propulsion device in accordance with claim 3 wherein said gimbal housing includes a lower portion, wherein said gimbal ring includes a lower portion, wherein said means removably connecting said gimbal ring to said gimbal housing includes a housing pin extending downwardly from said lower portion of said gimbal housing along said steering axis, and a gimbal aperture in said lower portion of said gimbal ring and receiving said housing pin, and wherein said gimbal ring is removable from said gimbal housing by lowering said gimbal ring until said gimbal aperture is removed from said housing pin.

9. A marine propulsion device in accordance with claim 3 wherein said gimbal housing includes a upper portion and a lower portion, wherein said gimbal ring includes an upper portion and a lower portion, wherein said means removably connecting said gimbal ring to said gimbal housing includes a housing aperture in said upper portion of said gimbal housing and centered on said steering axis, a housing pin extending downwardly from said lower portion of said gimbal housing along said steering axis, a gimbal pin extending upwardly from said upper portion of said gimbal ring and being received in said housing aperture, and a gimbal aperture in said lower portion of said gimbal ring and receiving said housing pin, and wherein said gimbal ring is removable from said gimbal housing by lowering said gimbal ring until said gimbal aperture is removed from said housing pin and said gimbal pin is removed from said housing aperture.

10. A marine propulsion device in accordance with claim 9 wherein said housing pin has an upper end fixed in said lower portion of said gimbal housing, a middle portion received in said gimbal aperture in said gimbal ring, and a lower end extending downwardly of said gimbal ring, and wherein said marine propulsion device further comprises means for supporting said lower end of said housing pin.

11. A marine propulsion device in accordance with claim 10 wherein said means for supporting said lower end of said housing pin includes a support housing removably connected to said lower portion of said gimbal housing and including a support portion extending beneath said lower portion of said gimbal ring and having therein a support aperture receiving said lower end of said housing pin.

12. A marine propulsion device in accordance with claim 9 wherein said gimbal pin has an upper part, and wherein said marine propulsion device further comprises a steering arm, and means for fixedly and removably attaching said steering arm to said upper part of said gimbal pin such that movement of said steering arm causes rotation of said gimbal ring about said steering axis.

13. A marine propulsion device in accordance with claim 12 wherein said means for fixedly and removably attaching said steering arm to said upper part of said gimbal pin includes a plurality of bolts extending through said steering arm and being threadedly engaged with said gimbal pin, and a plurality of pins extending through said steering arm and said gimbal pin, said bolts and said pins being generally parallel to said steering axis.

14. A marine propulsion device in accordance with claim 12 and further comprising means for supporting said gimbal ring against downward vertical displacement when said gimbal pin is received in said housing aperture and said housing pin is received in said gimbal aperture.

15. A marine propulsion device in accordance with claim 14 wherein said steering arm includes a lower surface, wherein said gimbal housing includes an upper surface having therein said housing aperture, and wherein said means for supporting said gimbal ring includes a thrust bearing positioned between a portion of said lower surface of said steering arm and said upper surface of said gimbal housing.

16. A marine propulsion device in accordance with claim 9 and further comprising means for supporting loads exerted upwardly on said gimbal ring.

17. A marine propulsion device in accordance with claim 16 wherein said gimbal housing includes a lower surface having said housing pin extending downwardly therefrom, wherein said lower portion of said gimbal ring has an upper surface having therein said gimbal aperture, and wherein said means for supporting loads exerted upwardly on said gimbal ring includes a thrust bearing between said lower surface of said gimbal housing and said upper surface of said lower portion of said gimbal ring.

18. A marine propulsion device comprising a gimbal housing adapted to be fixedly attached to a boat transom and including an upper portion having therein a housing aperture centered on a generally vertical steering axis, a lower portion, and a housing pin extending downwardly from said lower portion along said steering axis, said housing pin having a lower end, an intermediate portion, and an upper end fixedly attached to said lower portion of said gimbal housing, a support housing removably connected to said lower portion of said gimbal housing and including a support portion having therein a support aperture receiving said lower end of said housing pin, and a gimbal ring removably connected to said gimbal housing for pivotal movement of said gimbal ring relative to said gimbal housing about said steering axis, said gimbal ring including an upper portion having a gimbal pin extending upwardly therefrom and being received in said housing aperture, and a lower portion extending between said lower portion of said gimbal housing and said support portion of said support housing and having therein a gimbal aperture receiving said intermediate portion and said housing pin, said gimbal ring being disconnected from said gimbal housing by removing said support housing from said gimbal housing until said support aperture is removed from said housing pin, and lowering said gimbal ring until said gimbal aperture is removed from said housing pin and said gimbal pin is removed from said housing aperture.

19. A marine propulsion device in accordance with claim 18 and further comprising a pivot housing removably connected to said gimbal ring for pivotal movement relative to said gimbal ring about a generally horizontal tilt axis and for common pivotal movement with said gimbal ring about said steering axis, and a propulsion unit removably connected to said pivot housing for common pivotal movement with said pivot housing.

20. A marine propulsion device in accordance with claim 19 wherein said gimbal ring includes a main opening permitting passage of said pivot housing therethrough in response to rearward movement of said gimbal ring after disconnection of said gimbal ring from said gimbal housing and disconnection of said pivot housing from said gimbal ring.

21. A marine propulsion device in accordance with claim 20 wherein said gimbal ring includes spaced apart generally vertical side portions on opposite sides of said main opening, wherein said pivot housing has a portion positioned inside said main opening of said gimbal ring adjacent said side portions of said gimbal ring, and wherein said means for removably connecting said pivot housing to said gimbal ring includes, in each of said side portions of said gimbal ring, an aperture centered on said tilt axis and a bolt extending through said aperture and threadedly engaged with said portion of said pivot housing.

22. A marine propulsion device in accordance with claim 19 wherein said propulsion unit includes a rotatably mounted propeller, and a generally horizontal drive shaft drivingly connected to said propeller and extending through said pivot housing and said gimbal ring and being adapted to extend through the boat transom to be operably connected to an engine within the boat.

23. A marine propulsion device in accordance with claim 18 wherein said gimbal pin has an upper part, and wherein said marine propulsion device further comprises a steering arm, and means for fixedly and removably attaching said steering arm to said upper part of said gimbal pin such that movement of said steering arm causes rotation of said gimbal ring about said steering axis.

24. A marine propulsion device in accordance with claim 23 wherein said means for fixedly and removably attaching said steering arm to said upper part of said gimbal pin includes a plurality of bolts extending through said steering arm and being threadedly engaged with said gimbal pin, and a plurality of pins extending through said steering arm and said gimbal pin, said bolts and said pins being generally parallel to said steering axis.

25. A marine propulsion device in accordance with claim 24 wherein said gimbal housing further includes a removable cover for affording access to said steering arm.

26. A marine propulsion device in accordance with claim 24 and further comprising means for supporting said gimbal ring against downward vertical displacement when said gimbal pin is received in said housing aperture and said housing pin is received in said gimbal aperture.

27. A marine propulsion device in accordance with claim 26 wherein said steering arm includes a lower surface, wherein said gimbal housing includes an upper surface having therein said housing aperture, and wherein said means for supporting said gimbal ring includes a thrust bearing positioned between a portion of said lower surface of said steering arm and said upper surface of said gimbal housing.

28. A marine propulsion device in accordance with claim 18 and further comprising means for supporting loads exerted upwardly on said gimbal ring.

29. A marine propulsion device in accordance with claim 28 wherein said gimbal housing includes a lower surface having said housing pin extending downwardly therefrom, wherein said lower portion of said gimbal ring has an upper surface having therein said gimbal aperture, and wherein said means for supporting loads exerted upwardly on said gimbal ring includes a thrust bearing between said lower surface of said gimbal housing and said upper surface of said lower portion of said gimbal ring.

30. A marine propulsion device comprising a gimbal housing adapted to be fixedly attached to a boat transom an including an upper portion having therein a housing aperture centered on a generally vertical steering axis, and a lower portion having a housing pin extending downwardly therefrom along said steering axis, said housing pin having a lower end, an intermediate portion, and an upper end fixedly attached to said lower portion of said gimbal housing, a gimbal ring removably connected to said gimbal housing for pivotal movement of said gimbal ring relative to said gimbal housing about said steering axis, said gimbal ring including an upper portion having a gimbal pin extending upwardly therefrom, said gimbal pin having an upper part and being received in said housing aperture, and a lower portion having therein a gimbal aperture receiving said intermediate portion of said housing pin, a steering arm fixedly and removably attached to said upper part of said gimbal pin such that movement of said steering arm causes rotation of said gimbal ring about said steering axis, a support housing removably connected to said lower portion of said gimbal housing and including a support portion extending beneath said lower portion of said gimbal ring and having therein a support aperture receiving said lower end of said housing pin, a pivot housing removably connected to said gimbal ring for pivotal movement relative to said gimbal ring about a generally horizontally tilt axis and for common pivotal movement with said gimbal ring about said steering axis, and a propulsion unit removably connected to said pivot housing for common pivotal movement with said pivot housing.

31. A marine propulsion device in accordance with claim 30 wherein said gimbal ring includes a main opening permitting passage of said pivot housing therethrough in response to rearward movement of said gimbal ring after disconnection of said gimbal ring from said gimbal housing and disconnection of said pivot housing from said gimbal ring.

32. A marine propulsion device in accordance with claim 31 wherein said gimbal ring includes spaced apart generally vertical side portions on opposite sides of said main opening, wherein said pivot housing has a portion positioned inside said main opening of said gimbal ring adjacent said side portions of said gimbal ring, and wherein said means for removably connecting said pivot housing to said gimbal ring includes, in each of said side portions of said gimbal ring, an aperture centered on said tilt axis and a bolt extending through said aperture and threadedly engaged with said portion of said pivot housing.

33. A marine propulsion device in accordance with claim 30 wherein said means for fixedly and removably attaching said steering arm to said upper part of said gimbal pin includes a plurality of bolts extending through said steering arm and being threadedly engaged with said gimbal pin, and a plurality of pins extending through said steering arm and said gimbal pin, said bolts and said pins being generally parallel to said steering axis.

34. A marine propulsion device in accordance with claim 30 wherein said gimbal housing includes a removable cover for affording access to said steering arm.

35. A marine propulsion device in accordance with claim 30 and further comprising means for supporting said gimbal ring against downward vertical displacement when said gimbal pin is received in said housing aperture and said housing pin is received in said gimbal aperture.

36. A marine propulsion device in accordance with claim 35 wherein said steering arm includes a lower surface, wherein said gimbal housing includes an upper surface having therein said housing aperture, and wherein said means for supporting said gimbal ring includes a thrust bearing positioned between a portion of said lower surface of said steering arm and said upper surface of said gimbal housing.

37. A marine propulsion device in accordance with claim 30 and further comprising means for supporting loads exerted upwardly on said gimbal ring.

38. A marine propulsion device in accordance with claim 37 wherein said gimbal housing includes a lower surface having said housing pin extending downwardly therefrom, wherein said lower portion of said gimbal ring has an upper surface having therein said gimbal aperture, and wherein said means for supporting load exerted upwardly on said gimbal ring includes a thrust bearing between said lower surface of said gimbal housing and said upper surface of said lower portion of said gimbal ring.

39. A marine propulsion device in accordance with claim 30 wherein said propulsion unit includes a rotatably mounted propeller, and a generally horizontal drive shaft drivingly connected to said propeller and extending through said pivot housing and said gimbal ring and being adapted to extend through the boat transom to be operably connected to an engine within the boat.

40. A marine propulsion device comprising a gimbal housing adapted to be fixedly attached to a boat transom, a gimbal ring having an upper portion, means for connecting said gimbal ring to said gimbal housing for pivotal movement of said gimbal ring relative to said gimbal housing about a generally vertical steering axis, said means including a gimbal pin extending generally upwardly from said upper portion of said gimbal ring and having an upper surface, and a housing aperture in said gimbal housing receiving said gimbal pin, a propulsion unit connected to said gimbal ring for pivotal movement relative to said gimbal ring about a generally horizontal tilt axis, and for common pivotal movement with said gimbal ring about said steering axis, a steering arm, and means for fixedly attaching said steering arm to said upper surface of said gimbal pin such that movement of said steering arm causes rotation of said gimbal ring and of said propulsion unit about said steering axis, said means including a plurality of bolts extending through said steering arm and being threadedly engaged with said gimbal pin, and a pulraity of pins extending through said steering arm and said gimbal pin, said bolts and said pins being generally parallel to said steering axis.

41. A marine propulsion device in accordance with claim 40 and further comprising means for supporting said gimbal ring against downward vertical displacement when said gimbal pin is received in said housing aperture.

42. A marine propulsion device in accordance with claim 41 wherein said steering arm includes a lower surface, wherein said gimbal housing includes an upper surface having therein said housing aperture, and wherein said means for supporting said gimbal ring includes a thrust bearing positioned between said lower surface of said steering arm and said upper surface of said gimbal housing.

43. A marine propulsion device comprising a gimbal housing including an upper surface and being adapted to be fixedly attached to a boat transom, a gimbal ring having an upper portion, means for connecting said gimbal ring to said gimbal housing for pivotal movement of said gimbal ring relative to said gimbal housing about a generally vertical steering axis, said means including a gimbal pin extending generally upwardly from said upper portion of said gimbal ring, and a housing aperture in said gimbal housing receiving said gimbal pin, a steering arm including a lower surface and being fixedly attached to said gimbal pin such that movement of said steering arm causes rotation of said gimbal ring about said steering axis, and means for supporting said gimbal ring against downward vertical displacement when said gimbal pin is received in said housing aperture, said means for supporting said ginbal ring including a thrust bearing positioned between said lower surface of said steering arm and said upper sruface of said gimbal housing.

44. A marine propulsion device in accordance with claim 43 and further comprising a pivot housing removably connected to said gimbal ring for pivotal movement relative to said gimbal ring about a generally horizontal tilt axis, and for common pivotal movement with said gimbal ring about said steering axis, and a propulsion unit removable connected to said pivot housing for common pivotal movement with said pivot housing.

45. A marine propulsion device comprising a gimbal housing adapted to be fixedly attached to a boat transom and including a lower portion having a housing pin extending downwardly thereform along a generally vertical steering axis, said housing pin having a lower end, an intermediate portion, and an upper end fixedly attached to said lower portion of said gimbal housing, a gimbal ring removably connected to said gimbal housing for pivotal movement relative to said gimbal housing about said steering axis, said gimbal ring including a lower portion having therein a gimbal aperture receiving said intermediate portion of said housing pin, and a support housing removably connected to said lower portion of said gimbal housing and including a support portion extending beneath said lower portion of said gimbal ring and having therein a support aperture receiving said lower end of said housing pin.

46. A marine propulsion device in accordance with claim 45 and further comprising a pivot housing removably connected to said gimbal ring for pivotal movement relative to said gimbal ring about a generally horizontally tilt axis, and for common pivotal movement with said gimbal ring about said steering axis, and a propulsion unit removably connected to said pivot housing for common pivotal movement with said pivot housing.

47. A marine propulsion device comprising a gimbal housing adapted to be fixedly attached to the rear of a boat transom, a gimbal ring connected to said gimbal housing for steering movement about a generally vertical steering axis, a steering link, and means accessible from rearward of the boat transom for removably connecting said gimbal ring and said steering link so as to provide for pivotal movement of said gimbal ring relative to said gimbal housing about the steering axis in response to steering link movement.

48. A marine propulsion device comprising a gimbal housing adapted to be fixedly attached to a boat transom, a gimbal ring having an upper portion, means for connecting said gimbal ring to said gimbal housing for pivotal movement of said gimbal ring relative to said gimbal housing about a generally vertical steering axis, said means including a gimbal pin extending generally upwardly from said upper portion of said gimbal ring and having an upper surface, and a housing aperture in said gimbal housing receiving said gimbal pin, a propulsion unit connected to said gimbal ring for pivotal movement relative to said gimbal ring about a generally horizontal tilt axis, and for common pivotal movement with said gimbal ring about said steering axis, a steering arm, and means for fixedly attaching said steering arm to said upper surface of said gimbal pin such that movement of said steering arm causes rotation of said gimbal ring and of said propulsion unit about said steering axis, said attaching means including a bolt extending through said steering arm and being threadedly engaged with said gimbal pin.

* * * * *